US006746096B2

(12) United States Patent
Sakamoto et al.

(10) Patent No.: US 6,746,096 B2
(45) Date of Patent: Jun. 8, 2004

(54) RECORDING APPARATUS AND PREDISCHARGE CONTROL METHOD

(75) Inventors: Atsushi Sakamoto, Kanagawa (JP); Yuji Hamasaki, Kanagawa (JP); Hidehiko Kanda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/161,711

(22) Filed: Jun. 5, 2002

(65) Prior Publication Data

US 2003/0007030 A1 Jan. 9, 2003

(30) Foreign Application Priority Data

Jun. 7, 2001 (JP) ..... 2001-172743

(51) Int. Cl.[7] ..... B41J 2/165
(52) U.S. Cl. ..... 347/23; 347/35; 347/29
(58) Field of Search ..... 347/7, 14, 19, 347/22, 24, 29, 30, 23, 33, 35

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,608,577 A | | 8/1986 | Hori | 347/66 |
| 4,723,129 A | | 2/1988 | Endo et al. | 347/56 |
| 4,740,796 A | | 4/1988 | Endo et al. | 347/56 |
| 5,170,186 A | | 12/1992 | Shimamura et al. | 347/23 |
| 5,406,317 A | | 4/1995 | Shimamura et al. | 347/23 |
| 5,617,122 A | * | 4/1997 | Numata et al. | 347/14 |
| 5,907,336 A | | 5/1999 | Hayakawa | 347/29 |
| 6,193,351 B1 | | 2/2001 | Yaegashi et al. | 347/23 |
| 6,382,765 B1 | | 5/2002 | Kanda et al. | 347/23 |
| 6,447,095 B1 | | 9/2002 | Kanda et al. | 347/30 |

FOREIGN PATENT DOCUMENTS

| | | | |
|---|---|---|---|
| JP | 54-56847 | | 5/1979 |
| JP | 59-7053 | | 1/1984 |
| JP | 59-123670 | | 7/1984 |
| JP | 59-138461 | | 8/1984 |
| JP | 60-71260 | | 4/1985 |
| JP | 64-82962 | | 3/1989 |
| JP | 3-234638 | | 10/1991 |
| JP | 4-52219 | | 2/1992 |
| JP | 407047696 A | * | 2/1995 |
| JP | 10-278299 | | 10/1998 |

OTHER PUBLICATIONS

U.S. application No. 08/442,769, filed May 17, 1995 (now allowed) 6,447,095.

* cited by examiner

*Primary Examiner*—Shih-Wen Hsieh
(74) *Attorney, Agent, or Firm*—Fitzpatrick, Cella, Harper & Scinto

(57) ABSTRACT

A recording apparatus that comprises a cap, an idle suction device for exhausting the cap to the outside, a predischarge device for pre-discharging ink to the cap at designated time intervals, an accumulating device for accumulating the ink by the predischarge, a first comparison device for comparing the accumulated ink with a first threshold value, a first predischarge control device for reducing ink discharge in accordance with the first comparison result, a second comparison device for comparing the accumulated ink with a second threshold value, a predischarge prohibition device for prohibiting predischarge in accordance with the second comparison result, and a second predischarge control device for resuming predischarge in accordance with the period of time defined by the predischarge operation prohibition device, and increasing the ink for predischarge.

15 Claims, 5 Drawing Sheets

RECORDING APPARATUS AND PREDISCHARGE CONTROL METHOD

BACKGROUND OF THE INVENTION

1. Field of the Invention

The present invention relates to a recording apparatus and a predischarge control method. More particularly, the invention relates to a recording apparatus that records using an ink jet recording head, and a predischarge control method.

2. Related Background Art

The ink jet recording method is utilized for various kinds of printers, copying machines, facsimile equipment, and others, because it has such advantages as lower noises, lower running cost, easier downsizing of the apparatus, and easier recording of images in colors.

The recording apparatus that adopts this method records on a recording medium, such as paper, cloth, non-woven textile, OHP film, by discharging minute ink droplets from fine discharge ports of the ink jet recording head (hereinafter, referred to as a recording head). As a result, if the recording head is in a state where it is at rest continuously without any recording operation and does not discharge ink for a long time, ink in the ink discharge ports (hereinafter, referred to as discharge ports) is evaporated and dried eventually, hence excessively viscose ink or solidified ink being allowed to clog discharge ports to bring about dot mis-alignment (the phenomenon that ink discharge direction may change) or defective discharges. Here, therefore, in order to eliminate such drawback, the ink jet recording apparatus is provided with recovery means for performing recovery process to recovery the discharge condition of ink.

The ink jet recording apparatus (hereinafter, referred to as a recording apparatus) adopts the structure given below in order to solve the problems of dot mis-alignment and defective ink discharges due to the evaporation and drying of ink in discharge ports.

At first, the recording operation is at rest, a cap covers the discharge port surface of a recording head where discharge ports are formed, thus preventing ink in the discharge ports from being evaporated and dried. Should the viscosity of ink increase so as to allow ink to adhere to the discharge ports firmly with the defective discharges that may occur or should foreign substances adhere to the discharge port surface, the suction pump, which is connected to the inside of the cap, sucks overly viscous ink in the discharge ports or the foreign substances adhering to the discharge port surface to expel them. In this manner, recovery is executed to the normal discharge condition (this is referred to as a suction recovery).

Also, for the recording operation of the recording apparatus that adopts on-demand type ink jet recording method, all the discharge ports provided for one recording head are not necessarily used at all the time, and there exist some unused nozzles that are not used for a certain time or more. Also, for the color recording apparatus, which is provided with plural recording heads corresponding to each color ink, a certain recording head is not used entirely in some cases due to the absence of recording data to be transmitted.

Further, for the serial scan type where the carriage, on which heads are mounted, scans for recording, the carriage is required to scan or stop for a continuously long time in a state where the discharge port surface of a certain head, which is not in used, is uncapped, ink in the discharge ports, from which no ink discharges take place, is evaporated and dried. As a result, the ink discharge performance is degraded, hence inviting the degradation of quality of recorded images eventually.

To prevent such phenomenon, it is generally practiced for the recording apparatus to discharge ink at a designated location at intervals of certain time without regard to recording data so that ink in each nozzle is exhausted for replacement with flesh ink. In this manner, ink discharge condition is maintained appropriately at all the time. The ink discharge operation of the kind is called "predischarge".

Ink discharged as predischarges is directed to the location defined as the predischarge position, which is arranged in the cap of the recovery unit or arranged separately so as not to allow such ink to splash onto a recording medium or the interior of the recording apparatus to stain it. Lastly, then, ink discharged in such a manner is retained in a waste ink tank. The technique with which to discharge ink in the cap is disclosed in the specifications of Japanese Patent Application Laid-Open No. 59-7053 and Japanese Patent Application Laid-Open No. 04-52219, for example.

In recent years, for the enhancement of quality of recorded images, there has been proposed technique such as to improve the water-resistance by making ink insoluble on a recording medium or prevent spreading thereof on a recording medium with discharge of a specially treated recording capability enhancement liquid (hereinafter, referred to as processing liquid), besides ink, thus improving the quality of recorded images. For the recording apparatus that adopts such technique as this, plural receiving portions are arranged on positions apart from each other to receive ink and processing liquid when predischarges are performed. However, the provision of such plural receiving portions for predischarged ink and processing liquid leads to making the apparatus larger inevitably. Here, therefore, there has been proposed the utilization of the interior of cap as the predischarge position for the purpose of making the recording apparatus smaller.

Also, in recent years, it has been demanded to record images on an elongated recording sheet (banner paper) like a drop curtain. When recording on such an elongated recording sheet, the frequency of predischarges increases during recording operation as compared with recording on a sheet of regular size (A4, legal size, or the like) such as a usual copying sheet. The amount of ink used for predischarges increases accordingly. With the structure arranged to enable predischarges to be performed in the cap, the ink, which is pooled in the cap, should be sucked for removal appropriately (hereinafter, referred to as idle suction), and if the idle suction operates during recording operation, the reduction of throughput is invited.

To solve this problem, there has been proposed in the specification of Japanese Patent Application Laid-Open No. 03-234638 an idle suction of ink remaining in the cap each time when one-page portion of recording is completed, while performing predischarges in the cap.

Also, in the case of serial type recording apparatus where the carriage that has recording head mounted thereon reciprocates in the direction at right angles to the conveying direction of a recording medium, such as paper, it is generally arranged to provide the driving source (motor or the like) that drives mainly the carriage, the driving source that conveys the recording medium, and the driving source that drives recovery means for executing the recovery process to recovery the discharge condition of the recording head, and then, the structure is prepared to drive each of them as required. In recent years, however, along with the downsizing of recording apparatus, there have been made available many kinds of apparatuses that adopt the structure arranged to share a driving source for use of the conveyance of recording medium and the performance of recovery means from the viewpoint of cost down, and use such driving source by switching for the purpose. In the specification of Japanese Patent Application Laid-Open No. 01-82962, for example, it has been disclosed that a recording apparatus is arranged to use a motor dually as the motor to drive the suction pump for performing recovery process of the recording head and as the one to convey paper sheet serving as a recording medium.

However, the adoption of the structure, which is arranged to execute the conveyance control and recovery control by driving one and the same motor as the conventional example described above, has encountered the problems given below in some cases.

For example, in a state where recoding mediums (recording sheets, for instance) are set on a recording apparatus, the performance of recovery process that is intended to do then allows the recording sheet to be conveyed along with the recovery operation, because one and the same motor used for both operations. Therefore, the position of the recording sheet is displaced to make it impossible to continue recording images in good condition, or in some cases the recording sheet is put outside the conveyance mechanism on the way of recording. In order to solve such problems, it is necessary to effectuate control so that any recovery operation is not executed or any execution thereof is not allowed during the recording operation or while the recording sheet resides within the range of the conveyance mechanism.

Also, when recording is performed on an elongated recording sheet described earlier by use of such recording apparatus as this, the amount of ink used for predischarges becomes large, while it is made impossible to actuate the idle suction on the way of recording operation. Under such circumstances, the execution of predischarges results in overflowing of ink in the cap, and there is a fear that the interior of the recording apparatus is stained eventually. To solve this problem, there is a disclosure in the specification of Japanese Paten Application Laid-Open No. 10-278299 to the effect that predischarge control means is provided to prohibit predischarge to the cap when the amount of ink in the cap becomes beyond a designated amount. However, if predischarge to the cap is prohibited, there unavoidably exist the discharge ports that remain unused for a long time. As a result, the degradation of quality of recorded image is invited eventually. Also, the degradation of quality of the kind may exert influence not only on images currently recorded, but also, on those to be recorded next in some cases.

SUMMARY OF THE INVENTION

It is an object of the present invention to provide a recording apparatus capable of efficiently performing the predischarge that discharges ink, which does not contribute to image recording, from the recording head, and also, capable of reducing the contamination inside the recording apparatus.

It is another object of the invention to provide a recording apparatus that records images on a recording medium by use of an ink jet recording head to discharge ink from discharge ports comprises a cap covering the discharge port surface of the ink jet recording head having discharge ports formed thereon, being capable of receiving ink discharged from the discharge ports; idle suction means for exhausting ink received by the cap to the outside; predischarge means for pre-discharging ink from the ink jet recording head to the inside of the cap at designated time intervals aside from recording operation; accumulating means for accumulating the amount of ink consumption by the predischarge; first comparison means for comparing the amount of ink consumption accumulated by the accumulating means with a first threshold value per predischarge; first predischarge control means for controlling to reduce the amount of ink discharge for predischarge to follow in accordance with the comparison result provided by the first comparison means; second comparison means for comparing the amount of ink consumption accumulated by the accumulating means with a second threshold value larger than the first threshold value per predischarge of the amount of ink discharge reduced by the first predischarge control means; predischarge prohibition means for controlling to prohibit predischarge operation in accordance with the comparison result of the second comparison means; and second predischarge control means for controlling to resume predischarge to follow after the completion of recording operation in accordance with the period of time defined by the predischarge operation prohibition means for prohibiting predischarge operation, and to increase the amount of ink consumption for the predischarge.

Further, for the recording apparatus, it is desirable to provide idle suction control means for controlling to drive the idle suction means to perform idle suction operation after the completion of recording operation, and then, to control idle suction control means so that idle suction means is driven to perform idle suction operation prior to the start of recording operation in accordance with the comparison result of the first comparison means.

It is still another object of the invention to provide a predischarge control method used for a recording apparatus provided with an ink jet recording head, a cap covering the discharge port surface of the ink jet recording head having discharge ports formed thereon, being capable of receiving ink discharged from the discharge ports, predischarge means for pre-discharging ink from the ink jet recording head to the inside of the cap at designated time intervals aside from recording operation, and idle suction means for exhausting ink received by the cap to the outside, which comprises the accumulating step of accumulating the amount of ink consumption by the predischarge; first comparison step of comparing the amount of ink consumption accumulated in the accumulating step with a first threshold value per predischarge; first predischarge control step of controlling to reduce the amount of ink discharge for predischarge to follow in accordance with the comparison result in the first comparison step; second comparison step of comparing the amount of ink consumption accumulated in the accumulating step with a second threshold value larger than the first threshold value per predischarge of the amount of ink discharge reduced in the first predischarge control step;

predischarge prohibition step of controlling to prohibit predischarge operation in accordance with the comparison result in the second comparison step; and second predischarge control step of controlling to resume predischarge to follow after the completion of recording operation in accordance with the period of time defined in the predischarge operation prohibition step of prohibiting predischarge operation, and to increase the amount of ink consumption for the predischarge.

It is a further object of the invention to provide a predischarge control method used for a recording apparatus provided with an ink jet recording head and a cap covering the discharge port surface of the ink jet recording head having discharge ports formed thereon, which comprises the predischarge step of pre-discharging ink form the discharge ports of the ink jet recording head into the cap aside from the recording operation; accumulating step of accumulating the amount of ink consumption by the predischarge; compassion step of comparing the amount of ink consumption accumulated in the accumulating step; and predischarge control step of controlling to reduce the amount of ink discharge for predischarge to follow in accordance with the comparison result in the comparison step.

In accordance with the present invention, the predischarge can be performed efficiently and flexibly corresponding to the recording condition, while eliminating any possibility that ink, which resides in the cap by predischarge, is not allowed to overflow from the cap, hence producing an effect that the interior of the recording apparatus is prevented from being contaminated with ink.

DESCRIPTION OF THE PREFERRED EMBODIMENTS

Hereinafter, with reference to the accompanying drawings, the detailed description will be made of the preferred embodiments in accordance with the present invention.

Figure 1:
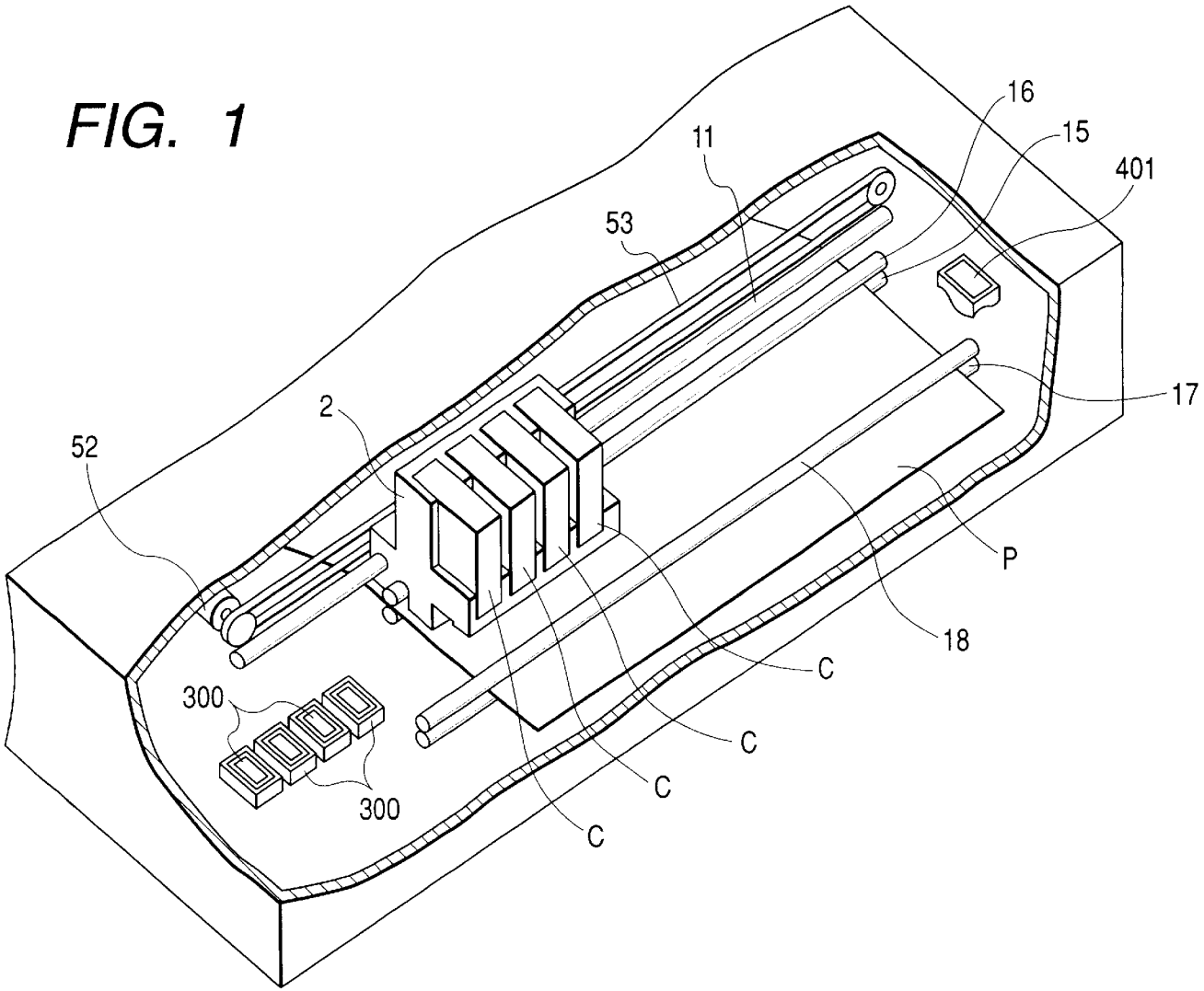
FIG. 1 is a perspective view that schematically shows the structure of a recording apparatus provided with the recording head that performs recording of ink jet recording type in accordance with the typical embodiment of the present invention.

FIG. 1 is a perspective view that schematically shows the structure of a recording apparatus provided with the recording head that performs recording of ink jet recording type in accordance with the typical embodiment of the present invention.

In FIG. 1, a reference numeral C designates the ink jet cartridge (hereinafter, referred to as a cartridge), which is provided with an ink tank above it and a recording head below it, as well as a connector for receiving signals or the like needed for driving the recording head; 2, a carriage that mounts plural cartridges C. Each of the ink tanks of the plural cartridges C contains ink of different colors, such as yellow, magenta, cyan, and black. Also, for the carriage 2, the connector holder is provided to transmit driving signals and others to the recording head of each cartridge C, and arranged to connect the recording head therewith electrically. In accordance with the example shown in FIG. 1, four cartridges C are mounted to contain ink of yellow, magenta, cyan, and black colors, respectively, in that order.

A reference numeral 11 designates the scanning rail that extends in the scanning direction of the recording head (main scanning direction), and slidably supports the carriage 2; 52, a carriage motor; 53, the driving belt that transmits the driving power of the carriage motor 52 to enable the carriage 2 to reciprocate in the main scanning direction; 15 and 16, and 17 and 18, the conveying roller pairs arranged before and after the position where the recording head records on a recording medium, which pinch the recording medium to convey it; and P, a recording medium, such as paper sheet. The recording medium P is in contact under pressure with the guiding surface of a platen (not shown), which regulates the recording surface thereof flat.

Also, the recording head provided for the cartridge C mounted on the carriage 2 protrudes downward from the carriage 2, which is positioned between the conveyance rollers 16 and 18, and the discharge port formation surface of the recording head where discharge ports are formed is opposite and in parallel to the recording medium P, which is in contact with the guiding surface of the platen (not shown).

Now, for the recording apparatus of the present embodiment, the recovery system unit is arranged on the home position side, which is on the left side in FIG. 1.

Regarding the recovery system unit shown in FIG. 1, a reference numeral 300 designates the cap unit arranged to face each of the recording heads provided for each of the four cartridges C, respectively, which is movable up and down. When the carriage 2 is at the home position, the cap unit 300 engages with the recording head to cap it, thus preventing ink in the discharge ports of the recording head from being evaporated so as to prevent defective discharges due to the increased viscosity of ink or the solidification thereof brought about by the evaporation of volatile component of ink.

Also, the inside of the cap unit 300 is communicated with a pump unit (not shown). The pump unit is negatively pressurized as required. The timing at which negative pressure is generated is such as to perform suction recovery by enabling the cap unit 300 and the recording head to be in contact when the recording head should present defective discharges or to idly suck predischarged ink in the cap of the cap unit 300, among some events, for example.

A reference numeral 401 designates the predischarge receiving portion, which is arranged on the side opposite to the home position with the area of recording operation for a recording medium P, and the predischarge of the recording head is performed in the predischarge receiving portion 401. Further, for the recovery system unit, the structure may be arranged in such a manner that the blade, which is formed by rubber of some other elastic member, is provided to wipe liquid droplets adhering to the discharge port formation surface of the recording head.

In this respect, the recording apparatus of the present embodiment is provided with one and the same motor for use as the driving motor for conveying a recording medium P and as the driving motor for operating the recovery system unit, which is shared for such uses.

Figure 2:
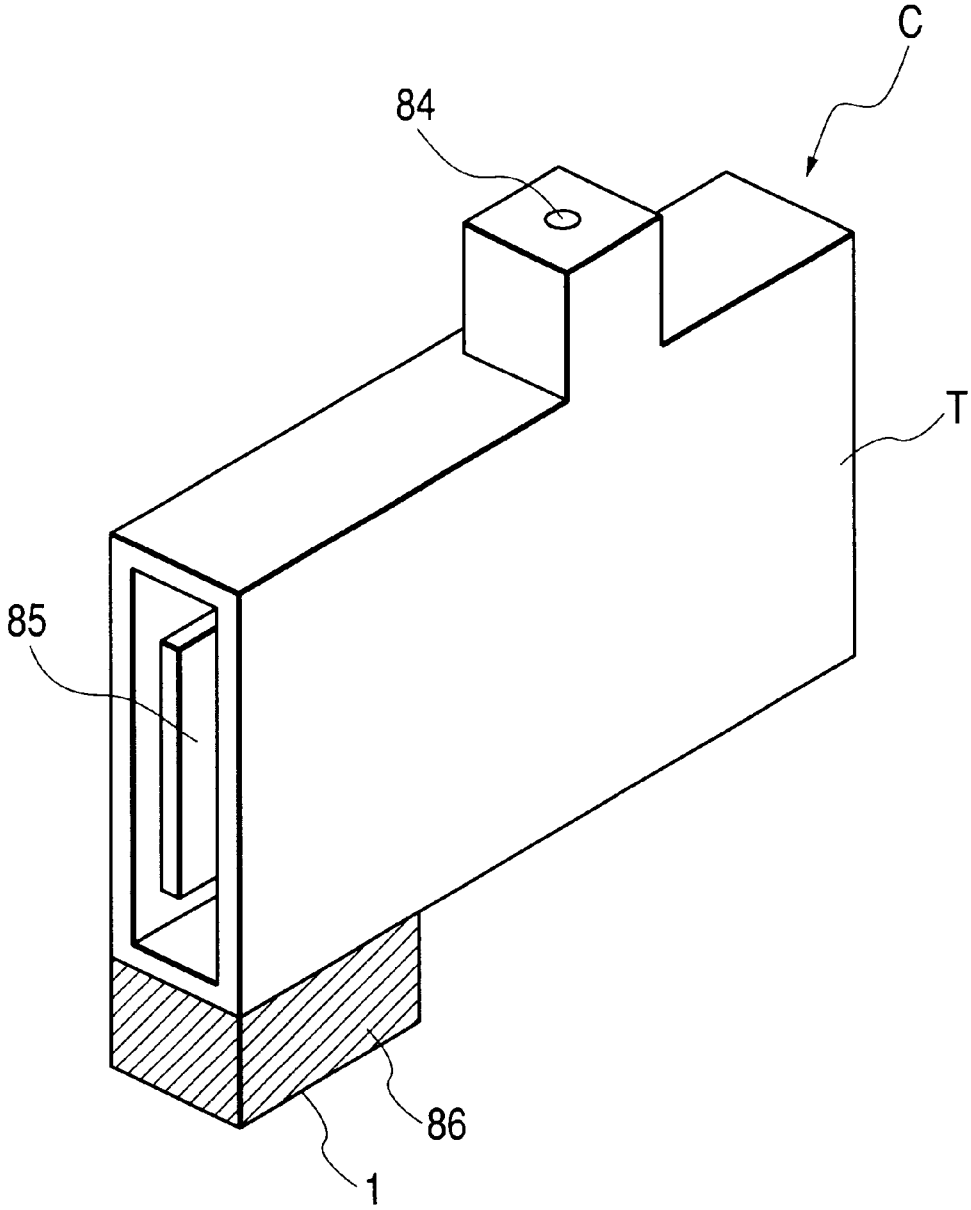
FIG. 2 is a perspective view that shows an ink jet cartridge used for the recording apparatus represented in FIG. 1.

FIG. 2 is a perspective view that shows an ink jet cartridge C having a recording head and an ink tank integrally formed therefor.

As shown in FIG. 2, the cartridge C has the ink tank T above and the recording head 86 below, and, further, on the upper portion of the ink tank T, an air hole 84 is arranged, and a connector 85 on the head side is arranged in a position alongside the ink tank T. The connector 85 recieves signals for driving the recording head 86, while outputting detection signals to indicate the amount of ink remainders. For the recording head 86, there is arranged the discharge port surface 1 having a plurality of discharge ports open to the bottom face side in the lower part of FIG. 2, and also, arranged on the liquid flow path portion communicated with each of the discharge ports, the electrothermal converting element that generates thermal energy required for discharging ink.

Figure 3:
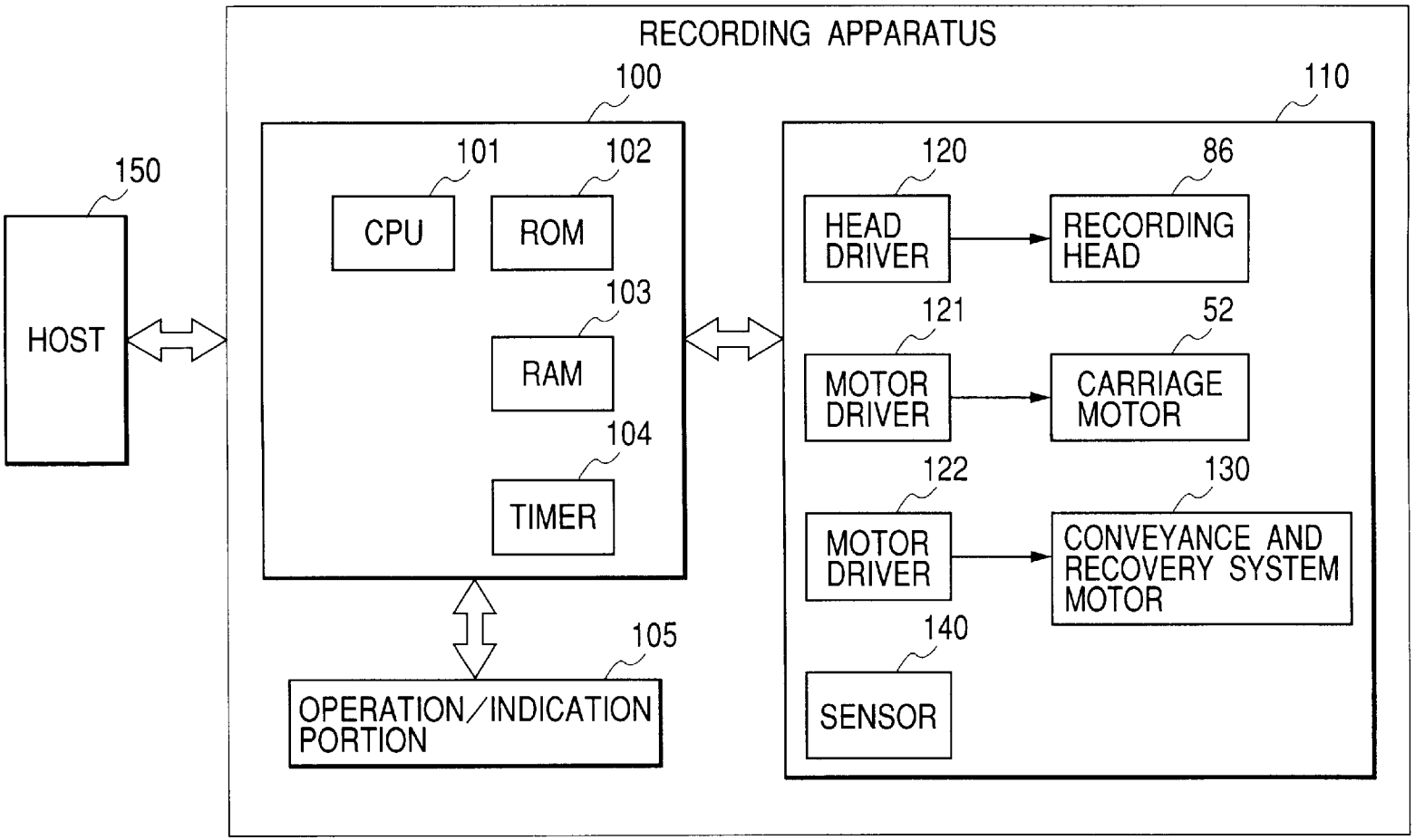
FIG. 3 is a block diagram that shows the structure of the control circuit of the recording apparatus represented in FIG. 1.

FIG. 3 is a block diagram that illustrates the controlling arrangement of the recording apparatus structured as described above.

As understandable from the representation of FIG. 3, the recording apparatus comprises a printer control portion 100 that controls each part of the apparatus; an operation indication portion 105 provided with various keys, LED, and LCD to issue various instructions to the recording apparatus and indicate the operating condition of the recording apparatus; and a driving portion 110 that drives mechanism for each part of the apparatus.

The printer control portion 100 comprises a CPU 101, a ROM 102, a RAM 103, a timer 104 that measures time, and others. The CPU 101 executes the program stored on the ROM 102 for the execution of control of each part of the apparatus. The printer control portion 100 is provided with an interface (not shown) for communicating with the host 150 that supplies recording data and control signals.

The driving portion 110 comprises the head driver 120, which drives each electrothermal converting element of the recording head 86 in accordance with recording data transmitted from the printer control portion 100; the motor driver 121, which drives a carriage motor 52 to enable the carriage 2 to move in the main scanning direction in accordance with signals from the printer control portion 100; and the motor driver 122, which drives the conveyance motor (dually functioning as the recovery system motor) 130 for the conveyance of a recording medium P in the sub-scanning direction by driving the sheet feed roller and sheet conveyance roller in accordance with signals from the printer control portion 100.

In this way, recording operation is executed on a recording medium P.

Also, the driving portion 110 is provided with a sensor for detecting the presence and absence of a recording medium P and various kinds of sensors 140 including the home position sensor and others that detect the movement of the carriage 2 to the home position. On the bases of the detection signals thus obtained, the CPU 101 recognizes the position of the carriage 2 and the presence and absence of the recording medium P as well.

In this respect, the conveyance motor 130 can drive the recovery unit for performing the recovery process to maintain and recover the discharge condition of the recording head 86 by switching over driving transmission gears (not shown).

Next, the predischarge operation will be described.

Figure 4:
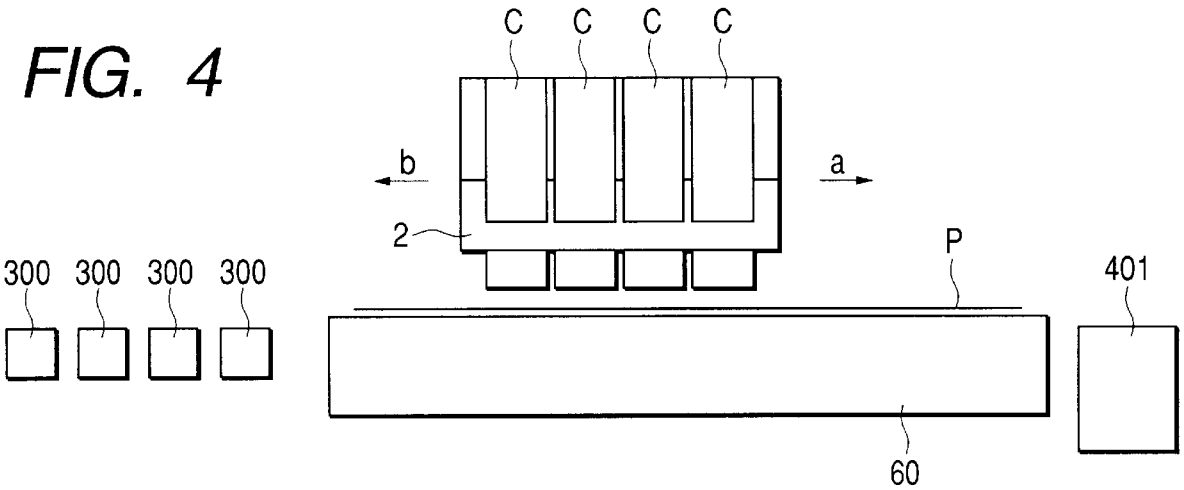
FIG. 4 is a view that illustrates the positional relations of the predischarge receiving portion of the recording apparatus represented in FIG. 1, and the operation of the predischarge as well.

FIG. 4 is the schematic view that shows the principal part of the recording apparatus observed from the front thereof.

In FIG. 4, a reference numeral 60 designates the platen, which forms the flat recording surface of a recording medium P, and on the upper surface thereof, the recording medium P is conveyed. Then, while the carriage 2 that mounts the recording head moves in the directions indicated by an arrow a and an arrow b, ink is discharged onto the recording medium P for recording images. In other words as shown in FIG. 4, the carriage 2 is made possible to record by scanning in either directions a and b (made possible to perform reciprocal recording). On the home position side, which is beyond the left side of the recording area for a recording medium P, the cap 300 is provided, and on the position beyond the right side of the recording area, the predischarge receiving portion 401 is provided.

Then, during recording operation, the carriage 2 moves either to the position where the cap 300 is provided or to the position the predischarge receiving portion 401 is provided at designated time intervals for the performance of predischarges.

Figure 5:
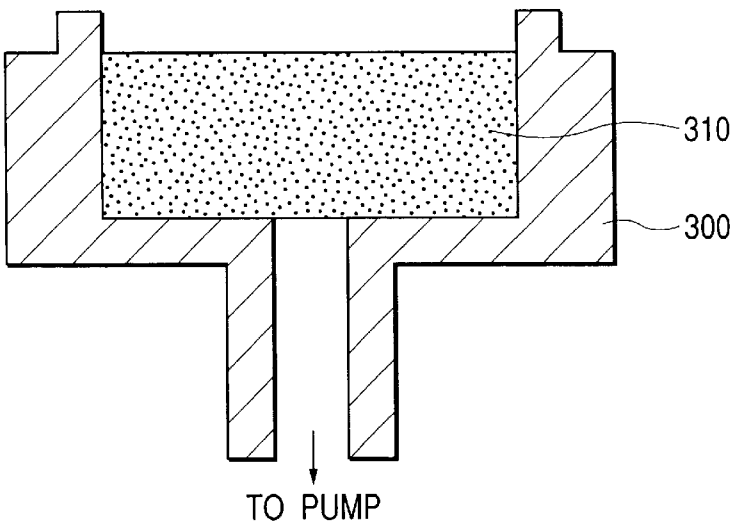
FIG. 5 is an enlarged sectional view that shows the cap represented in FIG. 4.

In this respect, when predischarges are executed inside the cap 300, it is preferable to provide an ink absorbent 310 for the inside of the cap 300 as shown in FIG. 5, which is a cross-sectional view of the cap 300, from the viewpoint of preventing ink leakage and ink rebounding.

In accordance with the present embodiment, the receivable amount of ink of the cap 300 is predetermined by the configuration and capacity of the cap 300, and on the bases thereof, the maximum discharge frequency of ink droplets that can be predischarged to the cap 300, that is, the maximum dot numbers (X2) is defined, and then, the dot numbers (X1), which is smaller than the X2, is established. In other words, the two-staged threshold value is prepared for the ink capacity of the cap 300 for the present embodiment.

The designed value of the maximum dot number (X2) should be not only smaller than the maximum capacity of the cap 300 when converted into the capacity, but also, it should be defined so that ink is not allowed to overflow by the movement of the cap 300 resulting from the up and down motion of the cap exercised to prevent the amount of discharges from increasing due to the temperature rise of the recording head or prevent ink evaporation from the discharge ports.

As shown in FIG. 5, it is preferable to provide ink absorbent 310 in the cap 300 for the prevention of ink leakage and rebounding. In this case, the maximum dot number (X2) should be determined taking the volume of the ink absorbent 310 into account, too. Also, it is preferable to make the maximum dot number (X2) larger than the predischarged dot number in the cap 300 at designated time intervals when the recording mode that requires the longest time is selected among the recording modes provided for the recording apparatus. The recording mode that requires the longest time is generally adopted for outputting photographic image on a special recording medium. Therefore, the higher image quality is desired for the output image. For this reason, it is necessary to keep the recording head in good condition at all the time for recording in the recording mode that requires the longest time. This necessitates predischarges.

If the maximum dot number (X2) is smaller than the predischarge dot number in the cap 300 in the mode that requires the longest time, moisture content in ink is evaporated from the discharge ports of the recording head to cause the ink discharge position to be disturbed or ink discharge to be disabled. There is a fear, then, that the quality of output image is degraded eventually. Here, the predischarge is performed at designated time intervals even when the user should issue a recording suspension command or the like unexpectedly. Therefore, while defining the maximum dot number (X2) so as to satisfy the conditions described above, it is arranged to prohibit the predischarge if the ink discharge to the cap 300 should become over the maximum dot number (X2). In this manner, it is made possible to prevent ink from overflowing from the cap 300 so as not to stain the inside the recording apparatus main body.

In contrast, when the high-speed recording mode is selected among those modes made available for the recording apparatus, it is preferable to define the dot number (X1) (referred to as the minimum dot number for the present embodiment, which is smaller than the aforesaid maximum dot number (X2)), for a number larger than the dot numbers, which are predischarged in the cap 300 at the designated time intervals for the selected mode. This definition is necessary because the operation (idle suction), which should be carried out to exhaust ink from the cap 300, is needed when such predischarge should become over the minimum dot number (X1) thus defined. In other words, if the minimum dot number (X1) is too small, the idle suction operation need to be executed per recording to exhaust ink from the cap 300, which leads to the reduction of throughput of the recording apparatus.

In this respect, for the indication that shows the dot numbers of ink droplets discharged to the cap 300, the ink volume (capacity) may be adopted for use if only the driving condition or the like has been established for the recording head 86, and then, by counting the dot numbers (N) of ink at the time of predischarges, it is possible to know the total volume of discharged ink to the cap 300. Also, if the dot number per predischarge is established, it may be possible to count the number of predischarges for the purpose. Or if the predischarges are executed periodically at designated time intervals using a timer, it may be possible to know the total volume of ink in the cap 300.

Next, the description will be made of the flow of the predischarge control in accordance with the present embodiment.

Figure 6:
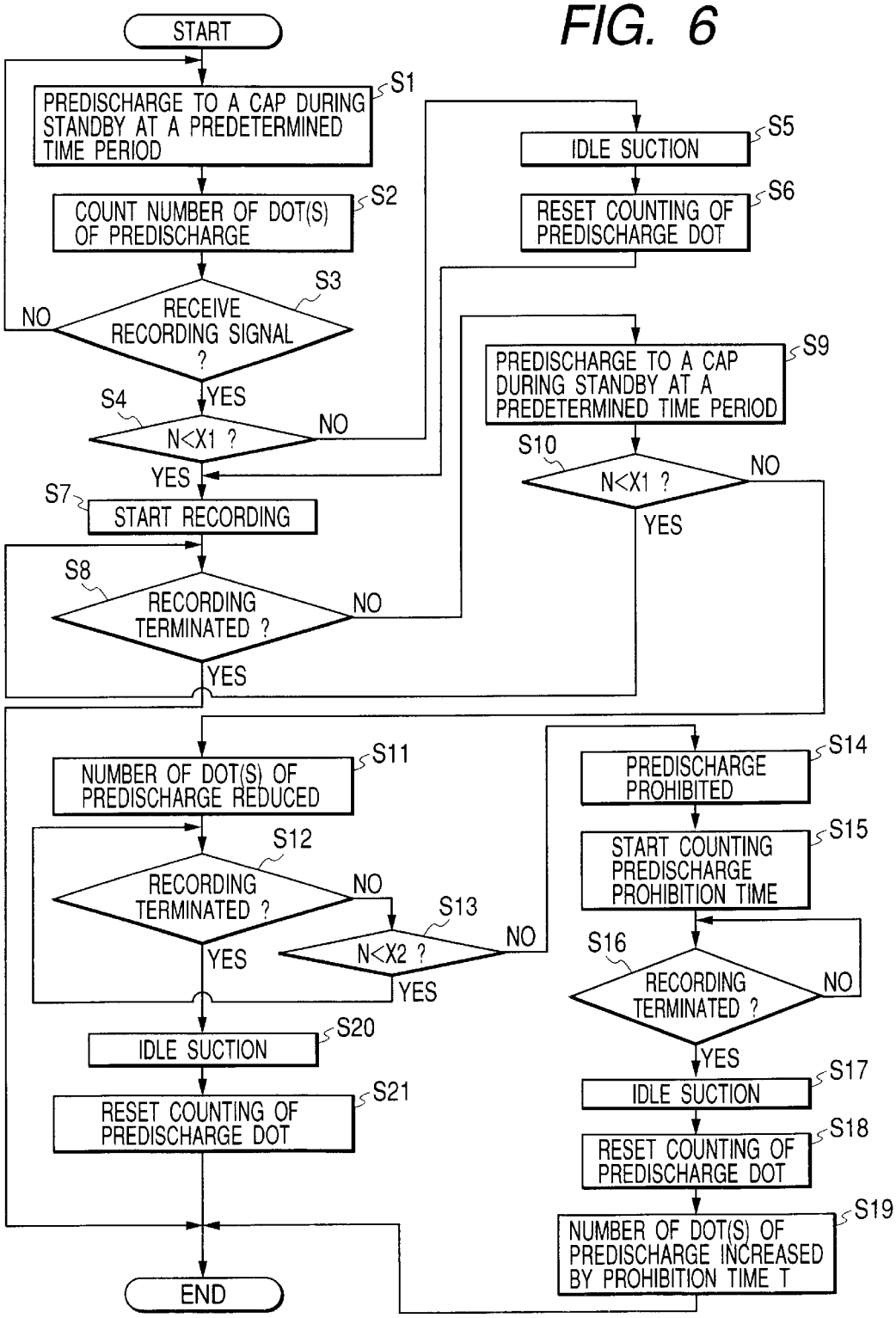
FIG. 6 is a flowchart that illustrates the control process of the predischarge.

FIG. 6 is a flowchart that shows the predischarge control process. In FIG. 6, the procedures are described with the recording apparatus being on standby at the outset.

In the standby condition, if predischarges have already been executed to the cap 300, the count (N) thereof indicates the portion of dot numbers thus predischarged to the cap or if no predischarge has been made, the count value indication is zero. This dot number counting may be implemented by use of either hardware or software. Either method of measurement will do.

At first, in step S1, the predischarge is performed to the cap 300 at designated time intervals even on the standby waiting for recording data from the host. In step S2, the dot numbers thus predischarged are added to the predischarge dot count value (N).

Next, in step S3, whether or not the recording signals are received from the host is examined. If negative, the process returns to the step S1. If affirmative, the process proceeds to step S4 where the counted value of predischarges (N) and the minimum dot number (X1) is compared before a recording medium (a recording sheet, for instance) is fed to the recording apparatus. Here, if the $N \geqq X1$, the process proceeds to step S5 where the idle suction is executed to exhaust ink from the cap. Further, in step S6, the dot counted value (N) of the predischarges is reset to zero. After that, the process proceeds to step S7.

On the contrary, if the $N<X1$, the process proceeds to the step S7 where recording begins. Next, in step S8, whether or not the recording is completed. Here, if it is determined that the recording is completed, the process terminates. On the contrary, if it is determined that the recording is still continued, the process proceeds to step S9 where predischarges are performed to the cap 300 at the designated time intervals even when recording is in operation. Continuously, in step S10, the predischarge counted value (N) and the minimum dot number (X1) is compared. Here, if the $N<X1$, the process returns to the step S8, but if the $N \geqq X1$, the process proceeds to step S11 where the discharge dot number of predischarges is reduced. Here, in the step S11, instead of the reduction of the discharge dot number, it may be possible to make the designated time intervals longer for the intended predischarges or to make the designated time intervals longer at the same time that the discharge dot number is reduced.

Subsequent to the step S11, whether or not the recording is completed is examined in step S12 as in the step S8. Here, if the recording is completed, the process proceeds to step S20 where the idle suction from the cap is executed. Further, in step S21, the predischarge counted value (N) is reset, and the process terminates. On the contrary, if it is determined that the recording still continues, the process proceeds to step S13.

In the step S13, whether or not the predischarge counted value (N) is smaller than the maximum dot number (X2), which is determined by the capacity and configuration of the cap 300 as described above, is examined. Here, if the $N<X2$, the process returns to the step S12, but if the $N \geqq X2$, the process proceeds to step S14 where ink discharges to the cap 300 is prohibited in order to prevent ink from overflowing from the cap 300.

Further, in step S15, the predischarge prohibition time (T) is measured beginning with the starting point set in the step S14 for the prohibition time of ink discharges to the cap 300. Then, in step S16, the process waits for the completion of recording, and if it is determined that the recording is completed, the measurement of the predischarge prohibition time (T) terminates, and the process proceeds to step S17. In this manner, the predischarge prohibition time (T) is measured up to the completion of recording. In the step S17, after the recording medium (sheet) has been expelled, the idle suction is executed to exhaust ink from the cap 300. Then, in step S18, the counted value (N) of the predischarge dots is reset.

Lastly, in step S19, depending on the measured predischarge prohibition time (T), the setting of the recording apparatus is conducted before the next recording operation as required so as to increase the discharge dot number for the predischarge to be executed at the designated time intervals.

Here, in the step S19, the process may be executed to make the predischarge time intervals smaller for the one to be performed on standby in accordance with the measured predischarge prohibition time (T) or to determine the time intervals and discharge dot number for a period until the next predischarge with reference to the table as shown, which has been prepared in advance for indicating the relationships between predischarge prohibition time (T), time intervals of predischarges, and discharge dot numbers. Table is the one used for selecting the discharge dot numbers and the executive time intervals for the predischarges to be executed in accordance with the predischarge prohibition time (T). Here, it is indicated in the Table that if the predischarge prohibition time (T) is 40 seconds (sec), the selected dot number is 200 for the one to be executed for the next predischarge at the time interval of 0.5 sec.

TABLE

| Predischarge prohibition time [sec] | Discharged dot number | Time interval [sec] |
|---|---|---|
| $0 \leqq T < 5$ | 30 | None |
| $5 \leqq T < 30$ | 60 | 1 |
| $30 \leqq T < 60$ | 200 | 0.5 |
| $60 < T$ | 800 | 0.5 |

After that, the process terminates and prepares for the reception of the next recording signals.

Here, in accordance with the embodiment described above, two different threshold values are prepared, and of the two, when recording begins using the smaller threshold value, the execution of idle suction is controlled based on the amount of ink to be consumed by the predischarges on the recording standby, and also, control is made so as to change the discharge dot numbers at the time of predischarges in accordance with the amount of ink consumed by the predischarges during recording operation. Further, control is made using the larger threshold value so as to prohibit predischarge in accordance with the amount of ink consumed by predischarged during recording operation. In this manner, it is made possible to perform predischarges flexibly and appropriately so as not to allow discharged ink to overflow from the cap depending on such condition as to wait for recording or to make progress in recording operation.

As a result, it becomes possible to prevent ink from overflowing into the recording apparatus to stain it with ink, and keep good balance between the ink consumption along with the predischarges and the optimal maintenance of the recording head. Also, while the amount of ink consumption for predischarges is suppressed, the recording head can be maintained in the optimum condition. Thus, the quality of recorded images can be maintained in good condition.

In addition, when recording is completed after the prohibition of predischarge, idle suction is executed to exhaust ink retained in the cap 300. After that, then, control is made to change discharge dot numbers for the predischarges at designated time intervals in accordance with the predischarge prohibition time. Therefore, it becomes possible to effectuate the flexible and optimal predischarges with the optimum balance between the amount of ink consumption needed for the predischarges and the maintenance of recording head in good condition.

In accordance with the description of the above embodiment, liquid droplets discharged from the recording head are ink, and further, liquid retained in the ink tank is ink. However, the content thereof is not necessarily limited to ink. For example, it may be possible to retain in the ink tank such processing liquid that may be discharged to a recording medium for the enhancement of the fixing capability or water resistance of recorded images or for the enhancement of the quality of recorded images.

Then, the embodiment described above makes it possible to attain recording in high density and high precision by use of the method, particularly among those of ink jet recording type, in which means for generating thermal energy as energy to be utilized for discharging ink (electrothermal converting element, laser beams, or the like, for example) is provided to create change of states in ink by the aforesaid thermal energy.

As regards the typical structure and operational principle of such method, it is preferable to adopt those implemental by the application of the fundamental principle disclosed in the specifications of U.S. Pat. Nos. 4,723,129 and 4,740,796, for example. This method is applicable to the so-called on-demand type recording, and continuous type as well. Here, the on-demand type is particularly effective, because it gives at least one driving signal to each of the electrothermal converting elements arranged for a sheet or a liquid path where liquid (ink) is retained, and provides an abrupt temperature rise beyond nuclear boiling in accordance with recording information to generate thermal energy by each of the electrothermal converting elements, hence creating film boiling on the thermal activation surface of recording head to effectively form resultant bubbles in liquid (ink) one to one corresponding to each of the driving signals. Then, by the development and contraction of each bubble, liquid (ink) is discharged through each of the discharge openings, hence forming at least one droplet. The driving signal is more preferably in the form of pulses because the development and contraction of the bubble can be made instantaneously and appropriately to attain performing particularly excellent discharges of liquid (ink) in terms of the response action thereof.

The driving signal in the form of pulses is preferably such as disclosed in the specifications of U.S. Pat. Nos. 4,463,359 and 4,345,262. In this respect, the temperature-increasing rate of the thermo-active surface is preferably such as disclosed in the specification of U.S. Pat. No. 4,313,124 for an excellent recording in a better condition.

As the structure of the recording head, there are included in the present invention, the structure such as disclosed in the specifications of U.S. Pat. Nos. 4,558,333 and 4,459,600 in which the thermal activation portions are arranged in a curved area, besides those which are shown in each of the above-mentioned specifications wherein the structure is arranged to combine the discharging openings, liquid paths, and the electrothermal converting elements (linear type liquid paths or right-angled liquid paths). In addition, the present invention is effectively applicable to the structure disclosed in Japanese Application Laid-Open No. 59-123670 wherein a common slit is used as the discharging openings for plural electrothermal converting elements, and to the structure disclosed in Japanese Patent Application Laid-Open No. 59-138461 wherein an aperture for absorbing pressure waves of thermal energy is formed corresponding to each discharge opening.

Further, as the recording head of full line type that has a length corresponding to the width of the largest recording medium recordable by the recording apparatus, it may be possible to adopt the structure in which plural recording heads such as disclosed in the aforesaid specifications are combined to satisfy the required length or to adopt the structure in which one integrally formed recording head is provided for the purpose.

In addition, it may be possible to use not only a cartridge type head having an ink tank integrally formed with the recording head itself, but also, use an exchangeable chip type recording head, which effectuates the electrical connection with or the ink supply from the main body of an apparatus possible when the head is installed on the main body of the apparatus.

Also, for the structure of the recording apparatus described above, it is preferable to additionally provide recording head recovery means and predischarge means because recording operation becomes more stable with the provision thereof. To name them specifically, these are capping means for the recording head, cleaning means, suction or compression means, pre-heating means such as electrothermal converting element or heating element other than such converting element or the combination of those types of elements. Here, also, the provision of predischarge mode that performs discharges other than the regular discharges is effective for the execution of stable recording.

Further, the apparatus may be arranged to provide not only a recording mode in which only main color such as black is used, but also, provide at least one of multi-color modes with ink of different colors, or a full-color mode using the mixture of the colors, irrespective of whether the recording heads are integrally structured or it is structured by a combination of plural recording heads.

In the embodiment described above, while ink has been described as liquid, it may be ink, which is solidified below the room temperature but soften or liquefied at the room temperature. Here, also, since ink is generally controlled for the ink jet method within a range of temperatures not lower than 30° C. and not higher than 70° C. in order to stabilize its viscosity for the performance of stable discharges, ink may be such as to be liquefied when recording signals are given for use.

In addition, it may be possible to use ink, which is liquefied only by the application of thermal energy, but solidified when left intact in order to positively prevent the temperature from rising due to the thermal energy by use of such energy as the energy which should be consumed for changing states of ink from solid to liquid, or in order to prevent ink from being evaporated. In either case, for the present invention, it may be possible to adopt the use of ink having a nature of being liquefied only by the application of thermal energy, such as ink capable of being discharged as ink liquid by enabling itself to be liquefied anyway when the thermal energy is given in accordance with recording signals, and ink which will have already begun solidifying itself by the time it reaches a recording medium. In such a case, it may be possible to retain ink in the form of liquid or solid in the recesses or through holes of a porous sheet such as disclosed in Japanese Patent Application Laid-Open No. 54-56847 or 60-71260 to enable ink to face the electrothermal converting element. For the present invention, the most effective method for the various kinds of ink mentioned above is that which is capable of implementing the film boiling method as described above.

Moreover, as the mode of the recording apparatus in accordance with the present invention, it may be possible to adopt a copying apparatus combined with a reader, in addition to the image output terminal for a computer or other information processing apparatus, and also, it may be possible to adopt a mode of a facsimile equipment having transmitting and receiving functions.

In this respect, the present invention is either applicable to a system formed by plural equipment (such as a host computer, an interface device, a reader, a printer, among some others) or to a single apparatus formed by one device (such as a copying machine, a facsimile equipment, among some others).

Also, it is readily understandable, that the objectives of the present invention is attainable by the provision of a system or an apparatus provided with a storage medium (or a recorded medium) having the programmed codes of software stored thereon to implement the functions of the aforesaid embodiment, and then, enabling the computer (or CPU or MPU) of the system or the apparatus to read out the stored programming codes on the storage medium for implementation thereof. In this case, the programming codes themselves, which are read out from the storage medium, implement the functions of the aforesaid embodiment. Therefore, it is construed that the storage medium that has stored such programming codes constitutes the present invention. Also, it is needless to mention that the present invention includes not only the case where the functions of the aforesaid embodiment are implemented by the execution of the programming codes read out by the computer, but also, the case where the operating system (OS) or the like, which is in operation on the computer, performs partly or totally the actual process on the basis of the instructions given by such programmed codes, and then, the functions of the aforesaid embodiments are implemented by the process thus executed.

Further, it is needless to mention that the present invention includes the case where the programmed codes are read out from the storage medium, and written on an expanded functional card inserted into the computer or on the memory provided for a expanded functional unit connected with the computer, and then, the functions of the aforesaid embodiments are implemented by the partial or total execution of the actual process by use of such expanded functional card or by the CPU or the like provided for such expanded functional unit on the basis of the instructions of the programmed codes thus written on the card or memory.

What is claimed is:

1. A recording apparatus for recording images on a recording medium by use of an ink jet recording head to discharge ink from discharge ports, comprising:

a cap covering a discharge port surface of said ink jet recording head having discharge ports formed thereon, being capable of receiving ink discharged from said discharge ports;

idle suction means for exhausting ink received by said cap to an outside of said cap;

predischarge means for pre-discharging ink from said ink jet recording head to an inside of said cap at designated time intervals aside from recording operation;

accumulating means for accumulating an amount of ink consumption by said predischarge;

first comparison means for comparing the amount of ink consumption accumulated by said accumulating means with a first threshold value per predischarge;

first predischarge control means for controlling to reduce the amount of ink discharge for predischarge to follow in accordance with the comparison result provided by said first comparison means;

second comparison means for comparing the amount of ink consumption accumulated by said accumulating means with a second threshold value larger than the first threshold value per predischarge of the amount of ink discharge reduced by said first predischarge control means;

predischarge prohibition means for controlling to prohibit predischarge operation in accordance with a comparison result of said second comparison means; and second predischarge control means for controlling to resume predischarge to follow after the completion of recording operation in accordance with a period of time defined by said predischarge operation prohibition means for prohibiting predischarge operation, and to increase the amount of ink consumption for the predischarge.

2. A recording apparatus according to claim 1, further comprising:

idle suction control means for controlling to drive said idle suction means to perform idle suction operation after the completion of recording operation.

3. A recording apparatus according to claim 2, wherein said idle suction control means controls to drive said idle suction means to perform idle suction operation prior to the start of said recording operation in accordance with the comparison result of said first comparison means.

4. A recording apparatus according to claim 1, wherein a first recording mode for recording at high speed and a second recording mode for performing high quality recording, but taking a time, are provided for the recording operation, and said first threshold value is defined on the bases of the amount of ink consumption for predischarge for recording in said first recording mode, and said second threshold value is defined on the bases of the amount of ink consumption for predischarge and the ink receiving amount of said cap for recording in said second recording mode.

5. A recording apparatus according to claim 4, wherein an ink absorbent is contained inside said cap, and said second threshold value is further defined in consideration of a volume of said ink absorbent.

6. A recording apparatus according to claim 1, wherein the amount of ink consumption for said predischarge is measured by discharge dot numbers.

7. A recording apparatus according to claim 6, wherein said accumulating means includes counting means for counting said discharge dot numbers.

8. A recording apparatus according to claim 7, wherein a counted value of said counting means is reset per ink exhaustion by said idle suction means.

9. A recording apparatus according to claim 6, wherein an increase and a decrease of the amount of ink consumption for predischarge by said first and second predischarge control means is made by the increase and decrease of said discharge dot numbers and/or by change of predischarge operational intervals.

10. A recording apparatus according to claim 1, wherein said second predischarge control means includes measurement means for measuring the time from the prohibition of predischarge by said predischarge prohibition means to an end of recording operation, and a reference table to be referenced for determining the amount of ink consumption for said resumed predischarge.

11. A recording apparatus according to claim 1, wherein said ink jet recording head is provided with electrothermal converting element for generating thermal energy given to ink for discharging ink by utilization of thermal energy.

12. A predischarge control method used for a recording apparatus provided with an ink jet recording head, a cap covering a discharge port surface of said ink jet recording head having discharge ports formed thereon, being capable of receiving ink discharged from said discharge ports, predischarge means for pre-discharging ink from said ink jet recording head to an inside of said cap at designated time intervals aside from recording operation, and idle suction means for exhausting ink received by said cap to an outside of said cap, comprising the following:

an accumulating step of accumulating an amount of ink consumption by said predischarge;

a first comparison step of comparing the amount of ink consumption accumulated in said accumulating step with a first threshold value per predischarge;

a first predischarge control step of controlling to reduce the amount of ink discharge for predischarge to follow in accordance with a comparison result in said first comparison step;

a second comparison step of comparing the amount of ink consumption accumulated in said accumulating step with a second threshold value larger than the first threshold value per predischarge of the amount of ink discharge reduced in said first predischarge control step;

a predischarge prohibition step of controlling to prohibit predischarge operation in accordance with the comparison result in said second comparison step; and a second predischarge control step of controlling to resume predischarge to follow after the completion of recording operation in accordance with the period of time defined in said predischarge operation prohibition step of prohibiting predischarge operation, and to increase the amount of ink consumption for the predischarge.

13. A method for controlling an ink jet recording apparatus for performing a recording operation by discharging ink from a discharge port, said method comprising:

a step of preliminarily discharging ink from said discharge port separately from said recording operation;

a step of accumulating an ink discharge amount caused in said preliminary discharge step;

a first comparison step of comparing the ink discharge amount accumulated in said accumulating step with a first threshold value;

a preliminary discharge control step of controlling to reduce the ink discharge amount in following preliminary discharge in accordance with a comparison result in said first comparison step;

a second comparison step of comparing the ink discharge amount accumulated in said accumulating step with a second threshold value which is larger than said first threshold value after said preliminary discharge control step; and a preliminary discharge inhibiting step of inhibiting the following preliminary discharge in accordance with the comparison result in said second comparison step.

14. A method according to claim 13, further comprising a second preliminary discharge control step of controlling to restore the ink discharge amount in the preliminary discharge by restarting the preliminary discharge in accordance with an inhibited period after termination of said recording operation.

15. A method for pre-discharging ink not concerning recording from a discharge port of an ink jet recording head for discharging ink to record, said method comprising:

a first step of pre-discharging ink from the discharge port of the ink jet recording head;

a second step of pre-discharging ink from the discharge port of the ink jet recording head with a discharge amount smaller than a discharge amount of ink in succeeding predischarge when the discharge amount of ink in the predischarge at the first step reaches a first threshold value; and a third step of pre-discharging ink from the discharge port of the ink jet recording head by changing a time interval for succeeding predischarge when, with a discharge amount smaller than a discharge amount of ink in succeeding predischarge, the discharge amount of ink in the predischarge at the first and second steps reaches a second threshold value.

* * * * *

UNITED STATES PATENT AND TRADEMARK OFFICE

CERTIFICATE OF CORRECTION

PATENT NO. : 6,746,096 B2
DATED : June 8, 2004
INVENTOR(S) : Sakamoto et al.

It is certified that error appears in the above-identified patent and that said Letters Patent is hereby corrected as shown below:

Title page,
Item [56], References Cited, FOREIGN PATENT DOCUMENTS, "JP 407047696 A" should read -- JP 7-47696 A --.

Column 1,
Line 15, "noises," should read -- noise, --.
Line 33, "recovery" should read -- recover --.

Column 2,
Line 65, "recovery" should read -- recover --.

Column 3,
Line 5, "cost down," should read -- lowering costs, --.
Line 18, "recoding" should read -- recording --.
Line 42, "Paten" should read -- Patent --.

Column 5,
Line 4, "form" should read -- from --.
Line 7, "compassion" should read -- comparison --.

Column 9,
Line 16, "need" should read -- needs --.

Column 15,
Line 14, "a time," should read -- more time, --.
Lines 16 and 18, "bases" should read -- basis --.

Signed and Sealed this

Fifth Day of April, 2005

JON W. DUDAS
*Director of the United States Patent and Trademark Office*